US005253708A

United States Patent [19]

Alexander

[11] Patent Number: 5,253,708

[45] Date of Patent: Oct. 19, 1993

[54] PROCESS AND APPARATUS FOR PERFORMING GRAVEL-PACKED LINER COMPLETIONS IN UNCONSOLIDATED FORMATIONS

[75] Inventor: Steve L. Alexander, Bakersfield, Calif.

[73] Assignee: Mobil Oil Corporation, Fairfax, Va.

[21] Appl. No.: 806,052

[22] Filed: Dec. 11, 1991

[51] Int. Cl.[5] ..... E21B 7/20; E21B 10/32; E21B 10/34; E21B 43/04

[52] U.S. Cl. ..... 166/278; 166/51; 175/267

[58] Field of Search ..... 166/278, 51; 175/69, 175/267, 276, 314

[56] References Cited

U.S. PATENT DOCUMENTS

| | | | |
|---|---|---|---|
| 3,817,339 | 6/1974 | Furse | 175/271 |
| 3,833,071 | 9/1974 | Koosman et al. | 166/51 X |
| 4,031,972 | 6/1977 | Burg | 175/263 |
| 4,091,883 | 5/1978 | Weber | 175/287 |
| 4,282,941 | 8/1981 | Perkin | 175/267 |
| 4,429,755 | 2/1984 | Williamson | 175/314 X |
| 4,438,815 | 3/1984 | Elson et al. | 166/51 X |
| 4,457,375 | 7/1984 | Cummins | 175/69 X |
| 4,565,252 | 1/1986 | Campbell et al. | 175/269 |
| 4,635,725 | 1/1987 | Burroughs | 166/51 X |
| 4,660,657 | 4/1987 | Furse et al. | 175/269 |
| 4,846,290 | 7/1989 | Jones | 175/269 |
| 4,872,509 | 10/1989 | Dickinson et al. | 166/51 X |
| 5,040,601 | 8/1991 | Karlsson et al. | 166/278 |
| 5,074,366 | 12/1991 | Karlsson et al. | 175/259 X |

OTHER PUBLICATIONS

Liner Drill-in Tools (1 Page) Designed for drilling-in liners with foam or other drilling fluids. Chancellor, Inc. Dec. 1989.

Liner Drill-in and Gravel Pack Method (1 Page) Chancellor, Inc. Dec. 1989.

Foam Gravel Packing pp. 10-13 SPE Production Engineering Feb. 1990.

*Primary Examiner*—George A. Suchfield

*Attorney, Agent, or Firm*—Alexander J. McKillop; George W. Hager, Jr.; Michael J. Mlotkowski

[57] ABSTRACT

A process for installing a gravel pack within an unconsolidated hydrocarbonaceous fluid-bearing formation. The process includes the steps of: drilling a bore hole to a first pre-determined depth; installing a well casing in the bore hole; lowering on a pipe string through the bore hole an apparatus for drilling and installing a slotted liner for gravel packing, the apparatus including a drill bit for drilling a pilot hole, means for enlarging the pilot hole to a diameter larger than the internal diameter of the well casing, the pilot hole enlarging means being initially retracted and located within a housing above the pilot hole drill bit, a slotted liner having a first end and a second end, the first end integrally joined to the apparatus above the housing and a drive assembly integrally joined to the second end of the slotted liner; rotating the apparatus to drill a pilot hole through the hydrocarbonaceous fluid producing zone; expanding the initially retracted pilot hole enlarging means upon exceeding the first pre-determined depth; enlarging the pilot hole to a diameter larger than the internal diameter of the well casing; continuing until the first end of the slotted liner reaches a second pre-determined depth depth; injecting a highly viscous fluid to maintain the diameter of the enlarged hole; installing a gravel pack tool assembly; and injecting a gravel slurry into an annulus defined by the enlarged hole and slotted liner to gravel pack the annulus.

10 Claims, 5 Drawing Sheets

PROCESS AND APPARATUS FOR PERFORMING GRAVEL-PACKED LINER COMPLETIONS IN UNCONSOLIDATED FORMATIONS

FIELD OF THE INVENTION

The present invention relates to the production of subterranean fluids and, in particular, to a process and apparatus for completing a well in an unconsolidated hydrocarbon-bearing formation.

BACKGROUND OF THE INVENTION

To recover valuable fluids from subterranean formations, wells are drilled from the surface of the earth to the productive formations. In the drilling of such wells, a rotating drill bit is commonly employed. As the bit rotates, penetrating through to the formation, material is dislodged in the form of cuttings. These cuttings are commonly removed from the well during the drilling operation by means of a drilling fluid, which may be comprise water, oil, an emulsion of water and oil or foam. The drilling fluid is circulated downward through the drill pipe and upward through the annulus between the drill pipe and the wall of the well, carrying the cuttings with it to the surface of the well in the form of a slurry. The drilling fluid also serves to cool the drill bit and can prevent blow-outs when drilling into strata containing high pressure fluids. When drilling a well, it is common to start with a relatively large diameter hole and cement surface casing in the hole. Subsequent drilling operations are then conducted through this casing. As drilling progresses deeper into the well, the diameter of the hole drilled may be reduced in steps, with progressively smaller diameters of casing employed in response thereto.

In seeking to recover hydrocarbon-bearing fluids from subterranean formations, it is often the case that such fluids are found to reside within formations which are unconsolidated. Unconsolidated formations often comprise poorly cemented sandstone which have little or no cementing material holding the grains of sand together. The production of hydrocarbons from unconsolidated formations often results in the concomitant production of sand. As those skilled in the art readily appreciate, the production of sand is undesirable for many reasons, chief among these being that it is abrasive to the components within the well, such as tubing, pumps, valves and the like, causing rapid erosion of such equipment and, in addition, may result in the partial or complete blockage of the well. Sand production is often rate sensitive, that is, no sand may be produced at very low rates of production, while at higher rates, large amounts of sand may be produced.

A variety of techniques have been employed to control the flow of sand from unconsolidated formations. Many of these techniques employ the use of slotted or screened liners or gravel packs to prevent the sand from being transported along with the hydrocarbons into the well. For example, in the heavy oil sands of California, well completions generally employ slotted liners. Typically, the slotted liner is drilled into the producing zone of the formation with foam, to a predetermined depth. Advantages accruing from the use of foamed-in liner completions include: reduced drilling expense, increased production and the biodegradability typical of such foams. However, these well completions, without being gravel packed across the unconsolidated producing zone, experience higher operational costs due to produced formation sand.

In certain situations, when attempting to install a gravel packed liner in an unconsolidated formation, a variety of problems can be encountered. One such problem arises when attempting to underream a drilled pilot hole with foam for a cleaner fluid prior to gravel packing. As is often the case, when conducting a conventional underreaming operation, the underreamed hole will collapse before the liner is positioned for gravel packing due to the unconsolidated nature of the formation and the fact that the underreaming tool must be removed before the gravel pack is installed.

Underreamers are a type of borehole tool which is used to enlarge a borehole which has already been drilled. In an underreaming operation, an expandable drilling tool is introduced through the casing to the point where underreaming is to be conducted. There, the underreamer is expanded to drill the formation to a larger diameter than the hole through which the underreamer passed. A typical underreamer includes expandable arms mounted in a housing by hinge pins for movement between a closed position and an open, expanded position. In the usual case, the expandable arms are moved outwardly by means of a pressure activated piston mounted within the main bore of the tool's housing. Underreamers come in a variety of types. One type of underreamer employs rotatable cone bits, mounted on the ends of the expandable arms for engaging certain types of formation and is generally referred to as a roller cone underreamer. Another earlier type of underreamer is known as a drag bit underreamer. In the drag bit underreamer, the expandable arms have a machined surface which is typically coated with a hard facing material for engaging and enlarging a borehole after the initial hole has been cut. The machined surface may have diamond bit implants such as those manufactured by General Electric under the trademark "Stratapax". As is known in the art, underreamers may be mounted at the end of the drill string or, in the case of a drilling type underreamer, mounted in the drill string above the drill bit.

Despite these advances in the art, there exists a need for an improved apparatus and method of placing a liner and gravel pack in an unconsolidated formation.

SUMMARY OF THE INVENTION

In accordance with the present invention, there is provided a process for forming a hole, placing a slotted liner therein and installing a gravel pack within an unconsolidated hydrocarbonaceous fluid-bearing formation. The process includes the steps of: drilling a bore hole to a first pre-determined depth above the hydrocarbonaceous fluid producing zone casing the bore hole; lowering on a pipe string through the cased bore hole an apparatus for drilling and installing a slotted liner for gravel packing, the apparatus including a drill bit for drilling a pilot hole, means for enlarging the pilot hole to a diameter sufficient for gravel packing, the pilot hole enlarging means being initially retracted within a housing above the pilot hole drill bit, a slotted liner having a first end and a second end, the first end integrally joined to the apparatus above the housing and a drive assembly joined to the second end of the slotted liner; rotating the apparatus to drill a pilot hole through the hydrocarbonaceous fluid producing zone; expanding the initially retracted pilot hole enlarging means upon exceeding the first pre-determined depth; enlarging the pilot hole to a diameter larger than the pilot bit and sufficient for gravel packing; continuing until the first end of the slotted liner reaches a second pre-determined depth, the second pre-determined depth sufficient to place the slotted liner within the hydrocarbonaceous fluid producing zone; injecting a highly viscous fluid to maintain the integrity of the enlarged hole; removing the liner drill-pipe assembly from the apparatus; installing a tubing tail and a gravel pack tool; and injecting a gravel slurry into an annulus defined by the enlarged hole and slotted liner to gravel pack the annulus.

Also provided is an apparatus for drilling and installing a gravel-packed liner, comprising: a drill bit for drilling a pilot hole; a housing mounted above the pilot hole drill bit; means for enlarging a pilot hole, the pilot hole enlarging means pivotally mounted within the housing and capable of pivoting between a retracted position and an expanded position for enlarging a pilot hole to a diameter sufficient for gravel packing; a slotted liner having a first end and a second end, the first end joined to the apparatus above the housing; and a drive assembly joined to the second end of the slotted liner.

Therefore it is an object of the present invention to provide an improved process for forming a hole and installing a gravel pack within an unconsolidated hydrocarbonaceous fluid-bearing formation.

It is another object of the present invention to provide a process for forming a hole and installing a slotted liner and gravel pack within an unconsolidated hydrocarbonaceous fluid-bearing formation which can be performed in no more than two trips into the well.

It is a further object of the present invention to provide an apparatus for drilling and installing a slotted liner for subsequent gravel packing.

Other objects and the several advantages of the present invention will become apparent to those skilled in the art upon a reading of the specification and the claims appended thereto.

BRIEF DESCRIPTION OF THE DRAWINGS

Reference may now be had to the following detailed description of exemplary embodiments of the invention, taken in conjunction with the accompanying drawings, in which.

DETAILED DESCRIPTION OF THE INVENTION

The present invention is best understood by reference to the appended figures, which are given by way of example and not of limitation.

Figure 1:
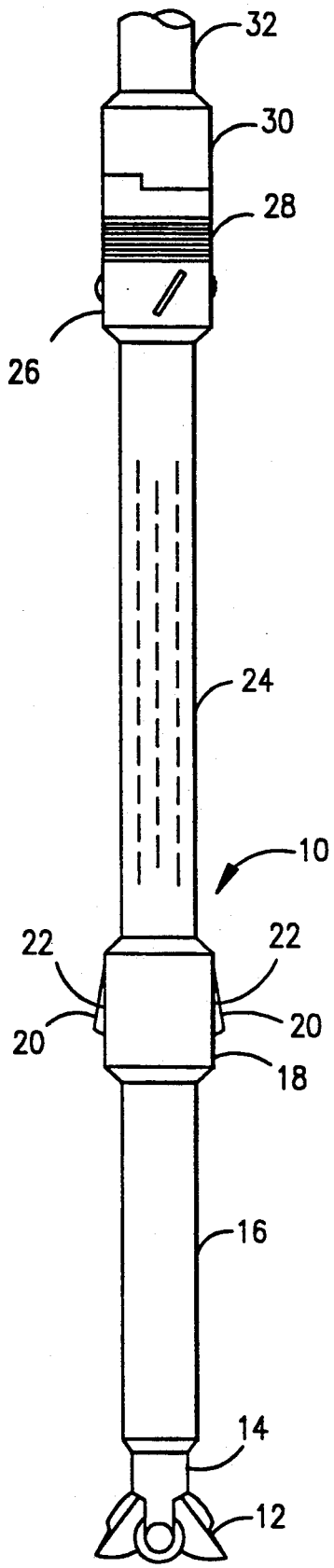
FIG. 1 presents an apparatus for drilling and installing a gravel-packed liner, in accordance with the present invention, showing two drag-type underreaming blades in the retracted position.
Figure 2:
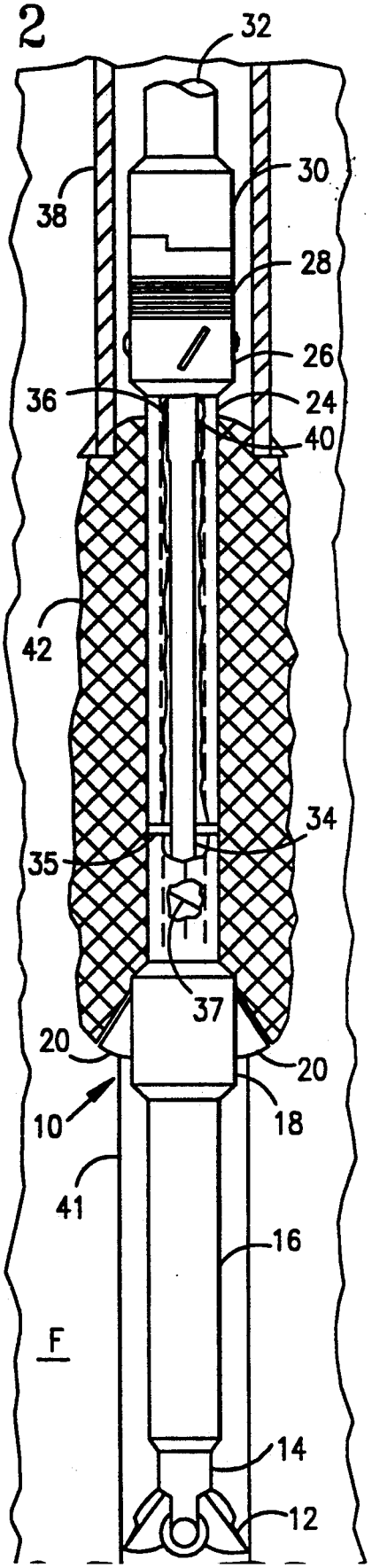
FIG. 2 shows the apparatus of FIG. 1, in partial cut-away, positioned within an unconsolidated formation.

Referring now to FIG. 1, an apparatus 10 for drilling and installing a gravel-packed liner is shown, in accordance with the present invention. Apparatus 10 includes a drill bit 12 for drilling a pilot hole, drill bit 12 welded to the bottom of optional blank liner section 16. Drill bit 12 employs a seal bore and check valve assembly 14 to allow a tubing tail 34 (see FIG. 2) to pass through the slotted liner section 24 to conduct drilling fluid circulation through the bit 12. As those skilled in the art appreciate, a wide variety of drilling fluids are known and readily available. Included among those drilling fluids suitable for use in the practice of the present invention are aqueous-based polymeric solutions, filtered water and preformed foams. Particularly preferred for many applications are the foam-based drilling fluids Welded to the top of optional blank liner assembly 16 is housing 18. Housing 18 serves to at least partially enclose a pilot hole enlarging means, which in the embodiment depicted in FIGS. 1 and 2 is a pair of underreaming drag blades 20. While a pair of underreaming drag blades are shown in the embodiment of FIGS. 1 and 2, it is to be understood that one, two, three or more drag blades 20 may be effectively used in apparatus 10 in order to enlarge the pilot hole drilled by bit 12. The use of two drag blades 20 is particularly preferred in the practice of the present invention. Underreaming drag blades 20 enter housing 18 through slots 22 when the drag blades 20 are in the initially retracted position. When in the expanded position (see FIG. 2), underreaming drag blades 20 are employed to enlarge a pilot hole to a diameter sufficient for gravel packing.

Welded to the top of housing 18 is a slotted production liner 24 having a length appropriate for the particular production zone sought to be gravel packed. On top of the slotted liner 24 is a drive assembly 26 which may be welded to the slotted liner 24, as preferred, to allow liner rotation while drilling. Drive assembly 26 also permits the installation of a sand control packoff assembly (not shown) after the slotted liner 24 is set at its desired depth. Drive assembly 26 includes drill-in nipple 28 to which is attached drive tool 30 which itself is affixed to bumper sub 32.

Referring now to FIG. 2, the apparatus 10 of FIG. I is shown, in partial cut-away, positioned within an unconsolidated formation F. Surface casing 38 is shown set to the top of formation F and cemented in place, as is customary. Apparatus 10 is shown with underreamer drag blades 20 in the expanded condition, with liner 24 having been drilled-in with foam, pilot hole 41 drilled to the designated depth and the underreamed annulus gravel packed with gravel 42. Slotted liner 24 is shown in partial cut-away to expose a portion of drill pipe assembly 40, including expansion joint 36, tubing tail 34, flexible seal 35 and check valve 37. Upon completion of the drill-in and gravel packing process of the present invention, bumper sub 32 and tubing tail 34, is then unstrung from apparatus 10, foamed clean, and removed.

Figure 3:
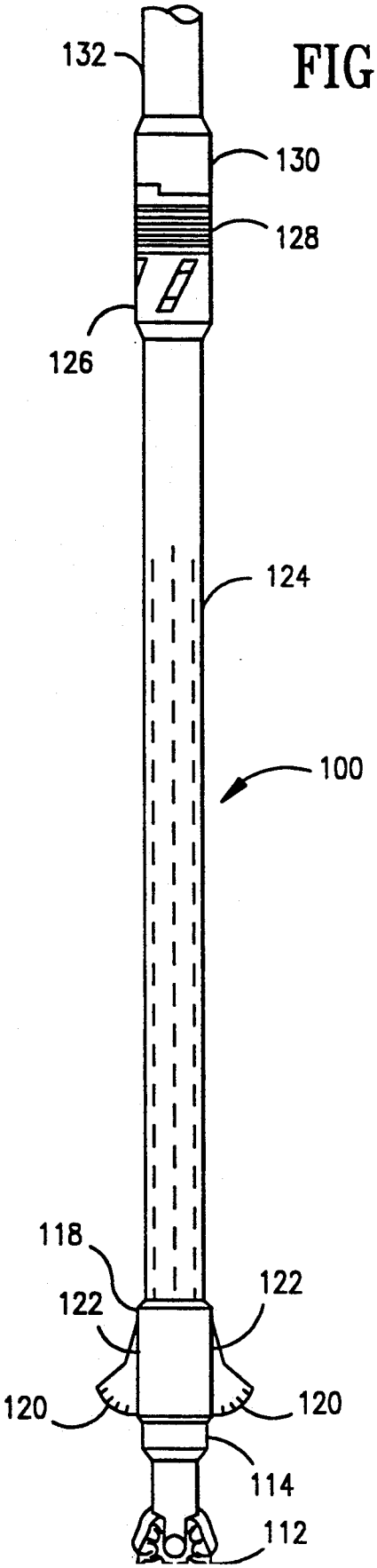
FIG. 3 presents another embodiment of an apparatus for drilling and installing a gravel-packed liner, having two drag-type underreaming blades shown in the retracted position.

Referring now to FIG. 3, another embodiment of the apparatus for drilling and installing a gravel-packed liner 100 is shown. Apparatus 100 has a pilot hole enlarging means, which as indicated above is a pair of underreaming drag blades 120. As may be seen, the pair of drag-type underreaming blades 120 are in the expanded position. A comparison of the embodiment of FIG. 3 with that of FIG. 1 reveals that apparatus 100 of FIG. 3 has no blank liner section positioned below housing 118 of apparatus 100, although it is shown to have a much longer section of slotted liner 124 installed above housing 118. As may be appreciated by those skilled in the art, such modifications are generally dictated by the formation itself and, as such, a wide variation in apparatus configurations is easily envisioned. Drive assembly 126 is provided to permit the installation of a sand control packoff assembly (not shown) after the slotted liner 124 is set at its desired depth. Drive assembly 126 includes drill-in nipple 128 to which is attached drive tool 130 which itself is affixed to bumper sub 132.

Figure 4:
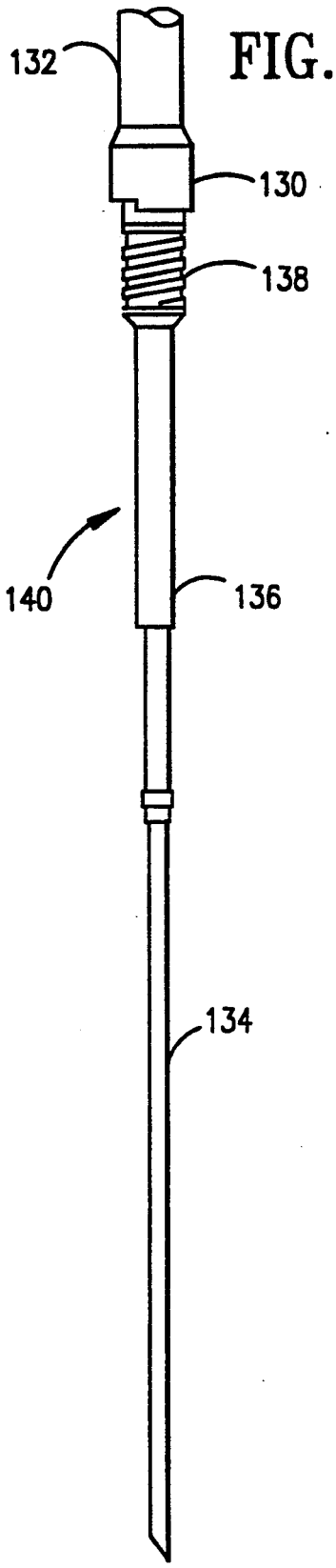
FIG. 4 shows a drill pipe assembly removed form the FIG. 3, apparatus.

FIG. 4 shows a drill pipe assembly 140 removed from the FIG. 3, apparatus. Drill pipe assembly 140 is comprised of tubing tail 134, an upper end of which is attached to expansion joint 136. The upper end of expansion joint 136 is welded to a left-hand threaded nut 138 which is provided for mating with an internal threaded portion of drill-in nipple 128.

Figure 5:
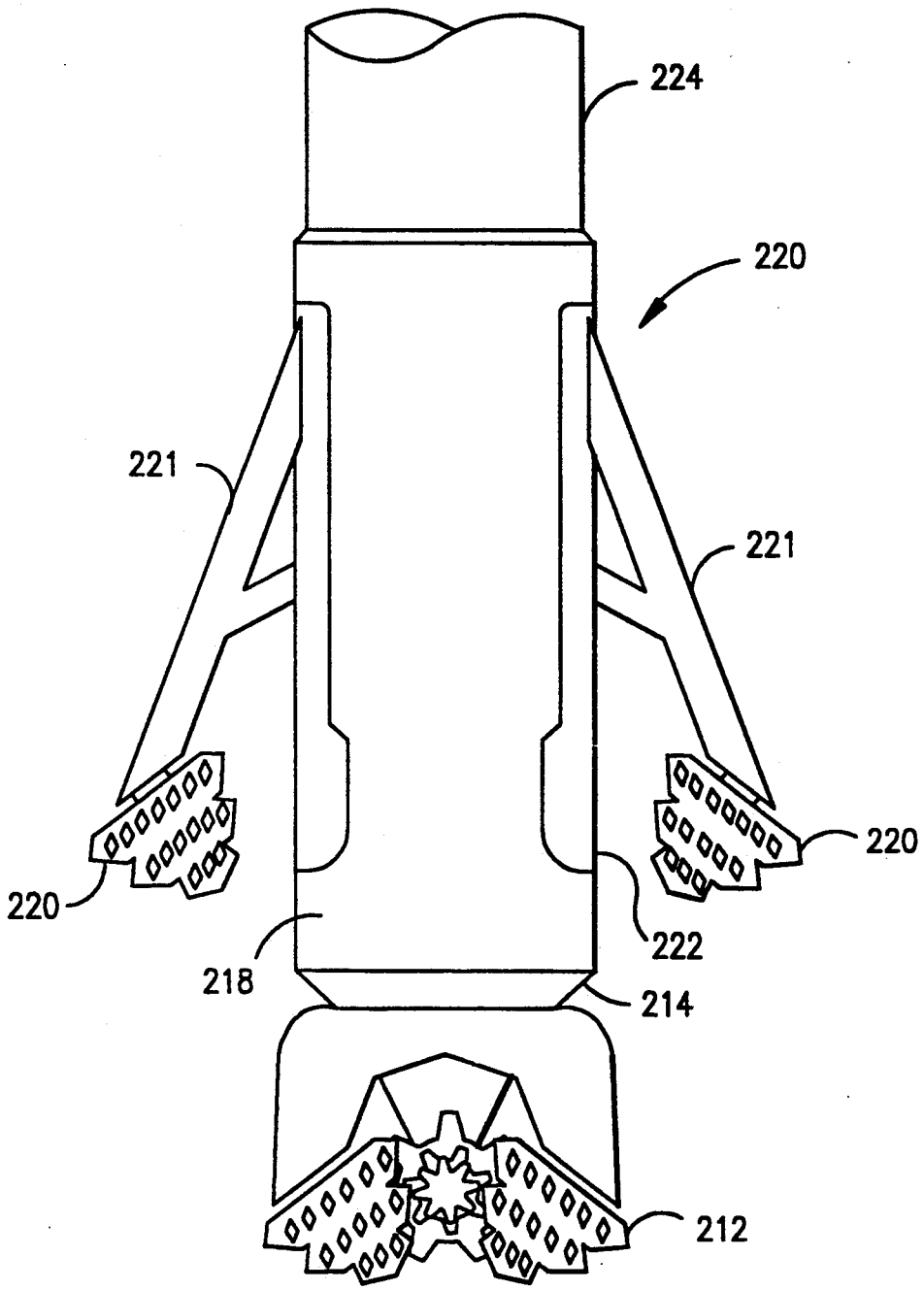
FIG. 5 presents an alternate means for enlarging a pilot hole, in accordance with the present invention.

FIG. 5 presents an alternate means for enlarging a pilot hole for use in an apparatus for drilling and installing a gravel-packed liner 200, in accordance with the present invention. As shown, the means for enlarging a pilot hole employs a pair of roller cone-type underreaming bits 220, depicted in the partially expanded position. While a pair of roller cone underreaming bits are shown in FIG. 5, it is to be understood that one, two, three or more roller cone bits 220 may be effectively used to enlarge the pilot hole drilled by bit 212. The use of two roller cone bits 220 is particularly preferred in the practice of the present invention. Apparatus 200 includes a drill bit 212 for drilling a pilot hole, drill bit 212 welded to the bottom of housing 218. Housing 218 serves to at least partially enclose underreaming roller cone bits 220 which enter housing 218 through openings 222 when the roller cone bits 220 are in the retracted position. Underreaming roller con bits 220 are affixed at the ends of bit arms 221, bit arms 221 used to expand and retract roller cone bits 220, as may be easily envisioned. As with the previously described embodiments of the present invention, when in the expanded position, underreaming roller cone bits 220 are employed to enlarge a pilot hole to a diameter sufficient for gravel packing. Welded to the top of housing 218 is a slotted production liner 224 having a length selected for the particular production zone sought to be gravel packed.

Figure 6:
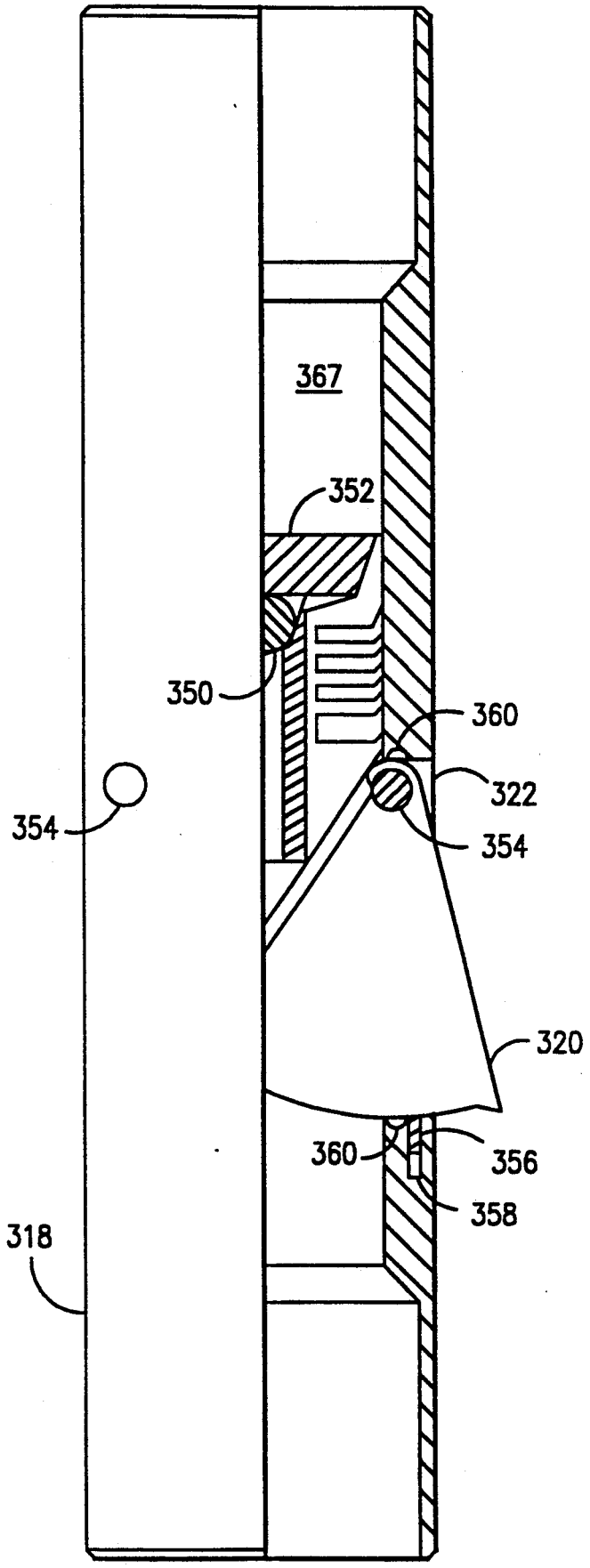
FIG. 6 schematically depicts a preferred mechanism for expanding the drag-type underreaming blades of the embodiments of FIGS. 1 and 3.
Figure 7:
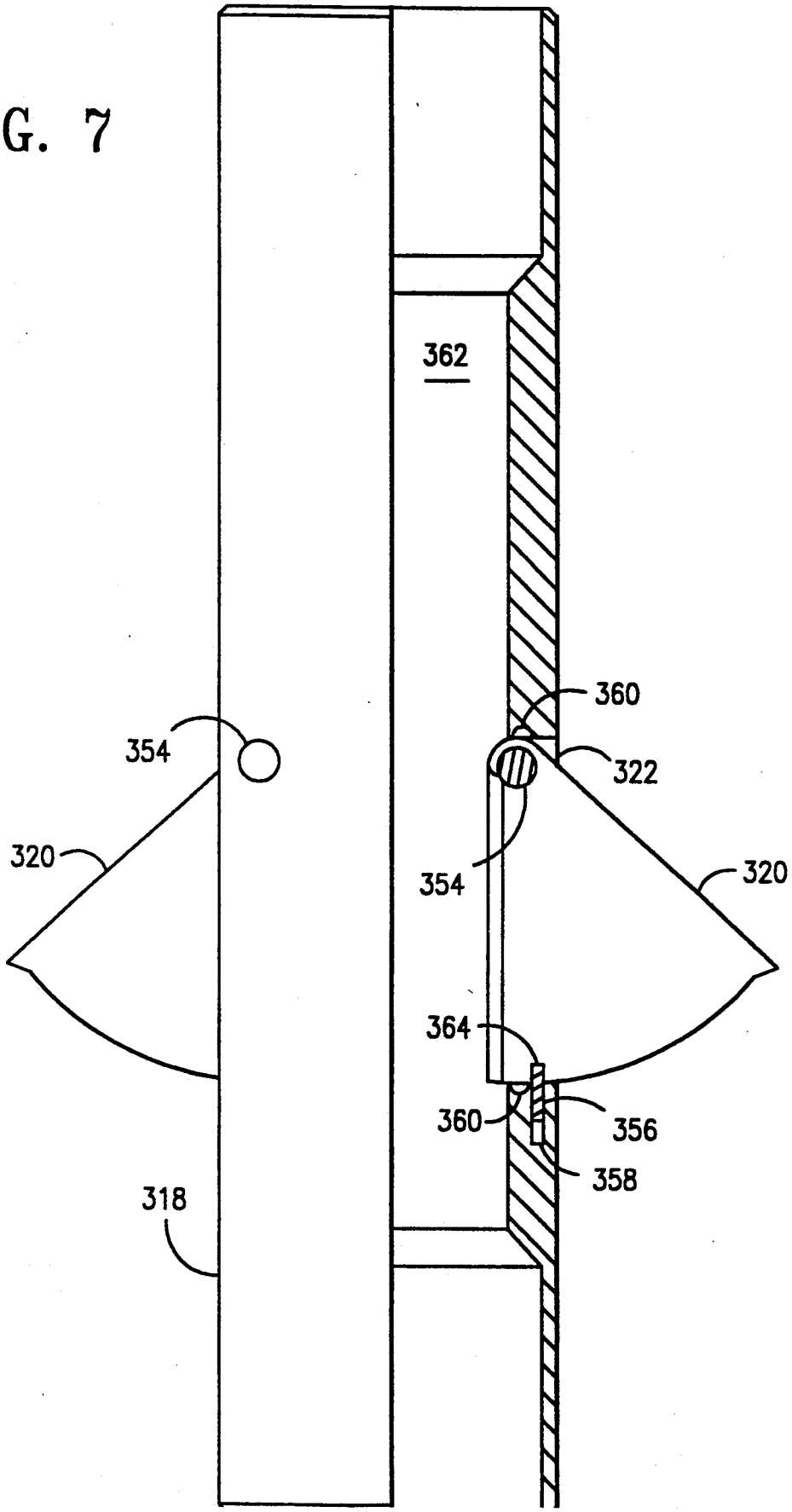
FIG. 7 shows the mechanism of FIG. 6 with the drag blades locked in the fully expanded position.

Referring now to FIG. 6, a partial cut-away view is provided in order to show a preferred mechanism for expanding drag blades 320 in schematic form. In operation, once housing 318 has reached the point at which underreaming is to be conducted, the underreamer drag blades 320 are expanded by foam pressure while rotating the apparatus and allowing sliding plunger 352 to slide down the apparatus, thus forcing drag-blades 320 out of slots 322 of housing 318. Drag blades 320 are locked open by the use of a shear pin 356, which may be loaded by spring 358 or by any suitable means (e.g. hydraulic pressure). Referring to FIG. 7, drag-blades 320 are shown locked in the expanded position by the interaction of spring-loaded shear pin 356 with key-way 364 of drag-blades 320. Once the drag-blades are placed in the expanded and locked position, the liner is drilled and underreamed into place. If it is desired to close the underreamer, a ball 350 can be dropped and hydraulically pressured to slide the plunger 352 down through the underreamer to a fluted assembly above the pilot hole drill bit with continued circulation through the pilot hole drill bit. This would then allow the liner to be drilled deeper into the formation or retrieved, without additional underreaming.

Referring once again to FIG. 2, in operation, the liner 24 is foamed drilled and underreamed to the designated depth. Once the desired depth has been reached the underreamed hole is foamed clean for a short period of time and the hole is circulated with a hydroxy ethylene cellulose (HEC) pill to maintain hole stability prior to gravel packing. The tubing tail is then unstrung from the drill-in assembly 40, foamed clean and pulled out. A conventional over the top gravel pack tool (not shown) is added to the completion tubing and ran back into the top of the liner with the tubing tail providing a return path for the gravel pack fluid, as those skilled in the art will readily understand. Filtered water, foam or a viscous fluid is used to gravel pack the liner with the sand laden fluid being pumped over the top of the liner and sand packed from the bottom up until gravel pack pressure is obtained and adequate sand has been put in place. The tubing and gravel pack assembly is then pulled out of the hole and a sand control packoff assembly (not shown) is driven over the liner top for the completion of the well.

The following specific example is presented herein to illustrate particular embodiments of the present invention an hence is illustrative of this invention and not to be construed in a limiting sense.

EXAMPLE

This example demonstrates the ability of the apparatus and process of the present invention to foam-drill a gravelpacked liner completion, utilizing underreaming.

Prior to beginning the completion process, surface casing was set to the top of a selected formation and cemented. A service rig complete with blow-out equipment, foaming unit and power swivel was then rigged up on the well. The casing float collar and casing shoe were drilled out in a conventional manner with water and circulated clean.

An apparatus in accordance with the present invention was used, the apparatus including a 7⅝" pilot hole drill bit welded to the bottom of the housing of the expendable underreamer. A seal valve and check valve assembly to allow a tubing tail to pass through the liner joint to conduct all foam circulation out through the pilot hole bit was employed. An appropriate length of slotted production liner was welded to the top of the underreamer bit housing. On top of the slotted liner, a drive assembly is welded to the liner to allow liner rotation while drilling, permitting the installation of a sand control packoff assembly after the liner was set at desired depth. The complete liner and drill-in assembly was run into the well bore on drill pipe.

Once the hole opener has cleared the end of the casing the hole opener was expanded to 15". This was accomplished, as previously described, by hydraulically sliding a plunger through the hole opener using foam pressure while rotating the assembly, forcing the blades of the drag-type underreamer out. The blades of the underreamer were locked through the use of a shear pins. The liner was then foamed drilled and underreamed to the designated depth.

Once the desired depth was reached, the underreamed hole was foamed clean for a short period of time and the hole is circulated with a hydroxy ethylene cellulose pill to maintain hole stability prior to gravel packing. The tubing tail was unstrung from the shoe assembly, foamed clean and pulled out of the hole.

A conventional over the top gravel pack tool was added to the completion tubing and ran back into the top of the liner with the tubing tail providing a return path for the gravel pack fluid. Filtered water was used to gravel pack the liner with the sand laden fluid being pumped over the top of the liner and sand is packed from the bottom up until the gravel pack pressure was obtained and adequate amount of sand was placed. The tubing and gravel pack assembly was then pulled out of the hole and a sand control packoff assembly driven over the liner top for the completion of the well.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A process for installing a slotted liner and gravel pack within an unconsolidated hydrocarbonaceous fluid-bearing formation, the formation having at least one hydrocarbonaceous fluid producing zone, the formation further having a bore hole drilled to a first pre-determined depth above the hydrocarbonaceous fluid producing zone and a well casing installed in the bore hole to about the first pre-determined depth, the well casing having an internal diameter, comprising the steps of:

(a) lowering on a pipe string through the bore hole an apparatus for drilling and installing a slotted liner for gravel packing, the apparatus including a drill bit for drilling a pilot hole, means for enlarging the pilot hole to a diameter larger than the internal diameter of the well casing and sufficient for gravel packing, the pilot hole enlarging means being initially retracted and located within a housing above the pilot hole drill bit, a slotted liner having a first end and a second end, the first end joined to the apparatus above the housing and a drive assembly integrally joined to the second end of the slotted liner;

(b) rotating the apparatus to drill a pilot hole through the hydrocarbonaceous fluid producing zone;

(c) expanding the initially retracted pilot hole enlarging means upon exceeding the first pre-determined depth;

(d) enlarging the pilot hole to a diameter larger than the internal diameter of the well casing and sufficient for gravel packing;

(e) continuing steps (b)-(d) until the first end of the slotted liner reaches a second pre-determined depth, the second pre-determined depth sufficient to place the slotted liner within the hydrocarbonaceous fluid producing zone;

(f) injecting a highly viscous fluid to substantially maintain the diameter of the enlarged hole;

(g) installing a gravel pack tool assembly; and (h) injecting a gravel slurry into an annulus defined by the enlarged hole and slotted liner to gravel pack the annulus.

2. The process of claim 1, wherein the highly viscous fluid injected in step (f) is an aqueous based polymeric solution.

3. The process of claim 1, further comprising the step circulating drilling fluid through the pipe string.

4. The process of claim 3, wherein the housing of the apparatus lowered into the well bore in step (a) has a longitudinal bore therethrough.

5. The process of claim 4, wherein the apparatus lowered into the well bore in step (a) includes a piston axially movable within the longitudinal bore of the housing in response to a force applied thereto.

6. The process of claim 5, wherein the means for enlarging the pilot hole to a diameter larger than the internal diameter of the well casing and sufficient for gravel packing includes at least one underreaming drag blade.

7. The process of claim 6, wherein the apparatus lowered into the well bore in step (a) further includes means connected to the at least one underreaming blade responsive to the downward movement of the piston within the longitudinal bore of the housing, the piston responsive means cooperating with the piston to effect the pivoting of the at least one underreaming blade from the initially retracted position to the expanded position for underreaming.

8. The process of claim 7, wherein the at least one underreaming drag blade is faced with a high strength material selected from the group including a diamond material and a hardened metal.

9. The process of claim 5, wherein the means for enlarging the pilot hole to a diameter larger than the internal diameter of the well casing and sufficient for gravel packing includes at least one roller-cone type underreaming bit.

10. The process of claim 9, wherein the apparatus lowered into the well bore in step (a) further includes means connected to the at least one underreaming bit responsive to the downward movement of the piston within the longitudinal bore of the housing, the piston responsive means cooperating with the piston to effect the pivoting of the at least one underreaming bit from the initially retracted position to the expanded position for underreaming.

* * * * *